United States Patent [19]

Baker et al.

[11] Patent Number: 4,626,055

[45] Date of Patent: Dec. 2, 1986

[54] ELECTRICAL CONNECTOR ASSEMBLY

[75] Inventors: Robert W. Baker, Harrow; Werner Lothmann, Ascot, both of England

[73] Assignee: AMP Incorporated, Harrisburg, Pa.

[21] Appl. No.: 505,622

[22] Filed: Jun. 20, 1983

[30] Foreign Application Priority Data

Jun. 22, 1982 [GB] United Kingdom ..... 8218116

[51] Int. Cl.[4] ..... H01R 11/00

[52] U.S. Cl. ..... 339/60 M; 339/94 M; 339/91 R

[58] Field of Search ..... 339/91 R, 94, 60, 61

[56] References Cited

U.S. PATENT DOCUMENTS

| | | | |
|---|---|---|---|
| 2,655,638 | 10/1953 | Allen | 339/94 M |
| 2,669,702 | 2/1954 | Klostermann | 339/94 M |
| 2,710,384 | 6/1955 | Dupre et al. | 339/94 M |
| 3,080,544 | 3/1963 | Scott et al. | 339/94 M |
| 3,120,987 | 2/1964 | Degnan et al. | 339/60 M |
| 3,683,315 | 8/1972 | Kelly | 339/60 R |
| 4,058,358 | 11/1977 | Caslisle | 339/94 M |

FOREIGN PATENT DOCUMENTS

| | | | |
|---|---|---|---|
| 2061027 | 5/1981 | United Kingdom | 339/94 R |

*Primary Examiner*—Gil Weidenfeld
*Assistant Examiner*—David L. Pirlot
*Attorney, Agent, or Firm*—Robert W. J. Usher

[57] ABSTRACT

The interface between a pair of mateable electrical connector housings (1) is sealed by means of an apertured resilient gasket (14) which is urged into tapered grooves (10) surrounding cavities (3) in one housing (1) by ribs (13) surrounding associated cavities (3) in the other housing (1), the gasket (14) being compressed between the ribs (13) and groove (14) walls while also being stretched about the ends of the ribs (13).

2 Claims, 11 Drawing Figures

ELECTRICAL CONNECTOR ASSEMBLY-

This invention relates to an electrical connector assembly comprising a pair of mateable housings each having at least one through cavity therein to receive an electrical terminal mateable with a terminal in an aligned cavity in the other housing on mating of the housings, and a sealing member located between mating faces of the housings and serving to provide sealing between the aligned cavities of the housings when mated.

In known such assemblies having a plurality of cavities in each housing the sealing member comprises an apertured sheet of resilient material which is positioned on a flat surface of one housing with the apertures in the sheet aligned with the cavities in the housing, the other housing having a surface which engages the sheet when the housings are mated which surface is formed with a ridge surrounding each cavity in the housing, the ridges pressing into the sheet to provide sealing about each pair of aligned cavities when the housings are mated.

Such known assemblies can provide efficient sealing as required, but have the disadvantages that the ridges can damage the sealing member such that sealing is not provided after a number of mating cycles of the housings, and that sealing is substantially wholly dependant upon the two housings being latched together with sufficient force to maintain the sealing member under compression, little if any sealing force deriving from the sealing member itself.

According to this invention an electrical connector assembly as set out above is characterised in that the mating face of one housing is formed with a groove surrounding the or each cavity, the or each groove tapering inwardly towards its bottom; the mating face of the other housing is formed with a tapered rib surrounding the or each cavity, the or each rib being freely receivable in the groove surrounding the associated cavity in the one housing; and the sealing member is in the form of an apertured sheet of resilient material mounted on the one housing with walls defining the or each cavity in the one housing extending through an individual aperture in the sheet, portions of the sheet being urged into the or each groove in the one housing by the or each rib on the other housing when the housings are mated.

The assembly of this invention has the advantage that the sealing member is placed under tension by the rib or ribs on the other housing as they urge the sealing member into the or each groove in the one housing on mating of the housing, the forces thus set up in the sealing member due to its resilience thus serving to maintain the sealing member in intimate sealing contact with the rib or ribs. Further, since the sealing member can be urged into the or each groove by the or each rib, since the sealing member is not supported over its entire surface by the one housing but extends across the underlying groove or grooves, effective sealing is provided over a relatively wide range of mating conditions of the housings, that is over a relatively wide range of spacings between the mating faces of the housings when mated.

An electrical connector assembly according to this invention will now be described by way of example with reference to the drawings, in which.

Figure 1:
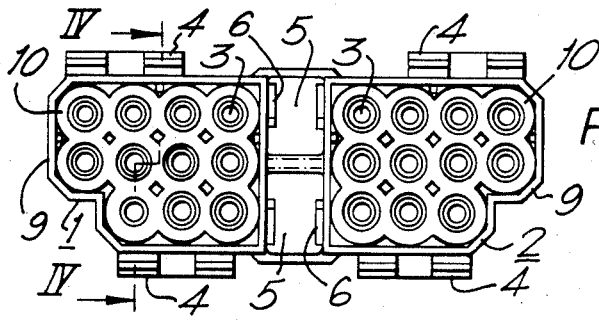
FIG. 1 is a view of one end of one housing of the assembly.
Figure 2:
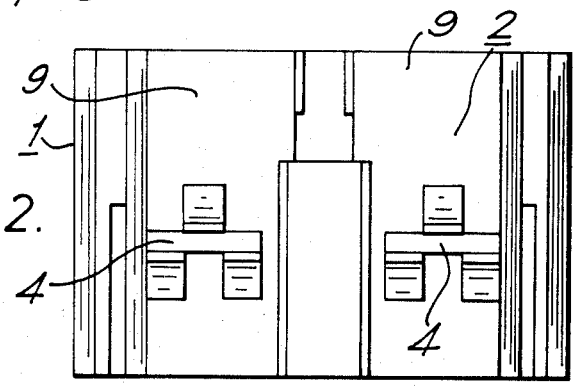
FIG. 2 is a plan view of the one housing.
Figure 3:
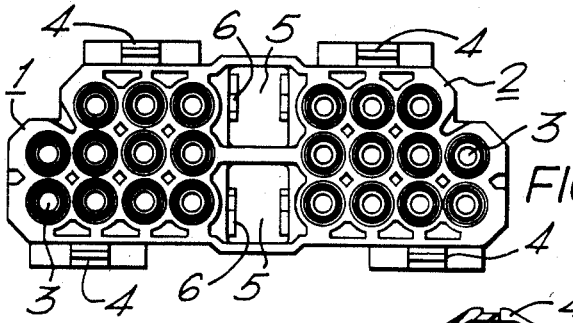
FIG. 3 is a view of the other end of the one housing.

The housing shown in FIGS. 1 to 4 is moulded from electrically insulating plastics material and comprises two integrally formed, parallel, substantially mirror-image parts 1 and 2 each formed with eleven through cavities 3 each to receive a pin terminal (not shown). The top and bottom surfaces of each part 1 or 2 are each formed with an arrangement of three latching limbs 4 by which the housing can be mounted in an aperture in a panel, in known manner. The two housing parts 1 and 2 are separated by two passages 5 each containing ramps 6 forming part of a housing latching arrangement as described in European Patent Publication No. EP-No. A-0039548.

Figure 4:
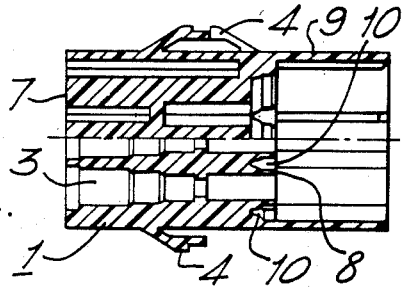
FIG. 4 is a cross-section on the lines IV—IV in FIG. 1.
Figure 5:
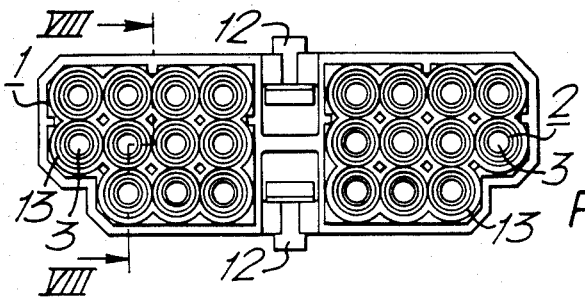
FIG. 5 is a view of one end of the other housing of the assembly.
Figure 6:
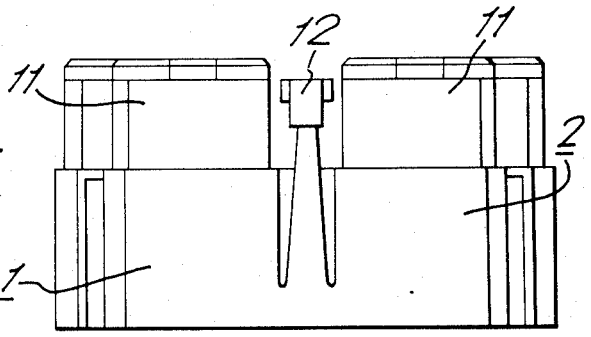
FIG. 6 is a plan view of the other housing.
Figure 7:
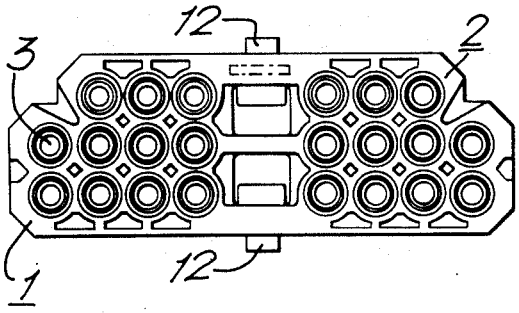
FIG. 7 is a view of the other end of the other housing.

Referring now specifically to FIG. 4, each cavity 3 extends through the housing from a terminating face 7 to a mating face 8 which is surrounded by an axially extending shroud 9. Where is opens to the mating face 8 each cavity 3 is surrounded by a groove 10 tapering inwardly towards its bottom.

The housing shown in FIGS. 5 to 8 is also moulded from electrically insulating plastics material and is similar in design to the housing of FIGS. 1 to 4, and similar parts have been given the same reference numerals. The cavities 3 are designed to receive receptacle terminals (not shown) which will mate with the pin terminals in the housing of FIGS. 1 to 4 when the housings are mated. Each part 1 and 2 of the housing is formed with a portion 11 shaped and sized to be received in the shroud 9 of the associated part 1 or 2 of the housing of FIGS. 1 to 4. The housing also carries two latching arms 12 which constitute the remainder of the housing latching arrangement mentioned above.

Figure 8:
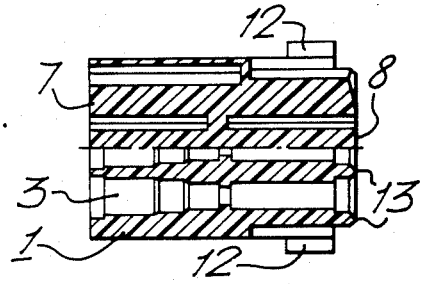
FIG. 8 is a cross-section on the line VIII—VIII in FIG. 5.

Referring specifically to FIG. 8, where it opens to the mating face 8 of the housing each cavity 3 is surrounded by a tapered rib 13, which as will be described more fully later, is freely receivable in the groove 10 surrounding the associated cavity 3 in the housing of FIGS. 1 to 4.

Figure 9:
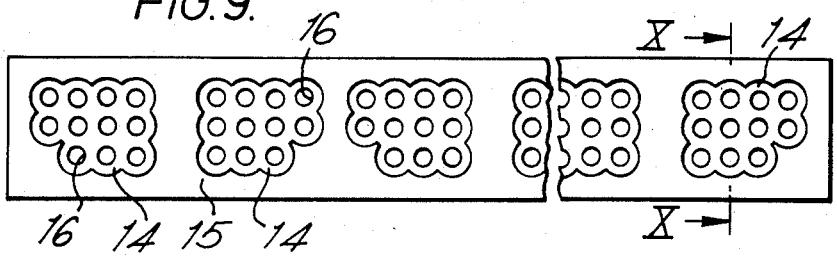
FIG. 9 is a plan view of a strip of sealing members as used in the assembly.
Figure 10:
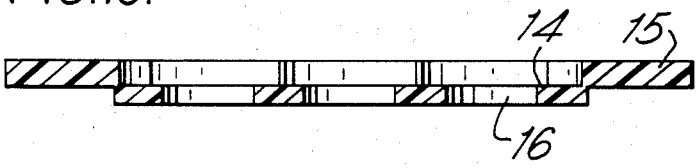
FIG. 10 is a section on the line X—X in FIG. 9.

FIGS. 9 and 10 show a plurality of sealing members 14 two of which are needed for an assembly using the housings of FIGS. 1 to 8. The sealing members are moulded in a row from a suitable resilient material such as neoprene, supported by a carrier strip 15. As shown in FIG. 10, each sealing member 14 is formed in a plane spaced from but parallel to the plane of the carrier strip 15, and is secured to the carrier strip 15 at its periphery only whereby the sealing member 14 can be easily removed from the carrier strip 15 when required.

The sealing member 14 is shaped to be received as a tight fit in the grooves 10 surrounding the cavities 3 of the housing of FIGS. 1 to 4, with apertures 16 in the sealing member 14 aligned with the cavities 3, the walls of the housing defining the cavities 3 extending into the apertures 16 in the sealing member 14.

Figure 11:
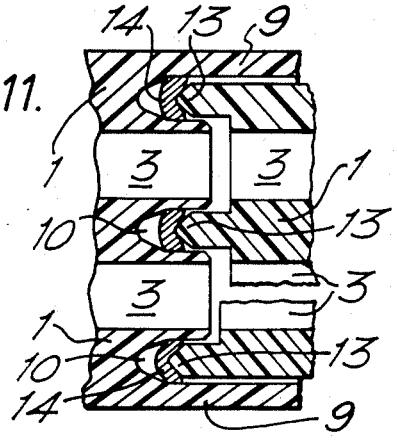
FIG. 11 is a scrap view illustrating operation of the sealing member in the assembly when the housings are mated.

Referring now to FIG. 11, this is a scrap view showing the co-operation between the grooves 10 in the housing of FIGS. 1 to 4, the sealing member 14 and the ribs 13 of the housing of FIGS. 5 to 8, when the housings are mated. As shown, the ribs 13 engage the sealing member 14 in the grooves 10, and urge the sealing member 14 towards the bottom of the gooves 10. Due to the tapered shape of the grooves 10 and the fit of the sealing member 14 in the grooves 10 and on the mating face 8 of the housing 1, the sealing member 14 is stretched over the ribs 13 and compressed against the walls of the grooves 10, thus providing sealing between the mating faces of the two mated housings. The co-operating latching ramps 6 and arms 12 on the two housings serve to secure the housings together in the mated condition.

FIG. 11 shows three pairs of aligned cavities 3 in the housings 1 with the associated sealing, the bottom rib 13 being shown inserted further into the associated groove 10 than the other two to illustrate how effective sealing is obtained over a relatively wide range of spacings between the mating faces of the housings.

We claim:

1. An electrical connector assembly comprising a pair of mated housings each having a plurality of through cavities therein receiving respectively electrical terminals mating with respective terminals in aligned cavities in the other housing, and a sealing member located between mating faces of the housings and sealing between the aligned cavities of the housings, the mating face of one housing being formed with grooves surrounding respective cavities, each groove tapering inwardly towards its bottom; the mating face of the other housing being formed with tapered ribs surrounding respective cavities, each rib being freely received in the respective groove surrounding the associated cavity in the one housing; and the sealing member being in the form of an apertured sheet of resilient material mounted to extend across the mating face of the one housing with walls defining the cavities in the one housing extending through respective individual apertures in the sheet, portions of the sheet havig been urged into each groove in the one housing by respective ribs on the other housing by the mating of the housings so that the portions of the sheet are in stretched condition over the tapered ends of the ribs and in compressed condition against the walls of the or each groove to provide the sealing, at locations spaced from the bottom of the or each groove.

2. An assembly as claimed in claim 1, in which the housings are provided with cooperating latching means serving to latch the housings together in the mated condition.

* * * * *